US006755442B2

(12) United States Patent
Franko, Sr. et al.

(10) Patent No.: US 6,755,442 B2
(45) Date of Patent: Jun. 29, 2004

(54) EXTENDED TEXT WRAP LABEL AND METHOD OF MANUFACTURE THEREOF

(75) Inventors: Joseph D. Franko, Sr., Ham Lake, MN (US); Todd C. Wentz, Rogers, MN (US)

(73) Assignee: Quality Assured Enterprises, Inc., Minnetonka, MN (US)

( * ) Notice: Subject to any disclaimer, the term of this patent is extended or adjusted under 35 U.S.C. 154(b) by 0 days.

(21) Appl. No.: 09/927,989

(22) Filed: Aug. 10, 2001

(65) Prior Publication Data

US 2003/0030270 A1 Feb. 13, 2003

(51) Int. Cl.[7] ..... B42D 15/00

(52) U.S. Cl. ..... 283/94; 283/81; 283/101; 283/106; 428/40.1; 428/42.1

(58) Field of Search ..... 283/81, 94, 98, 283/101, 106; 428/40.1, 41.7, 41.8, 42.1, 42.2, 42.3

(56) References Cited

U.S. PATENT DOCUMENTS

| | | | | | |
|---|---|---|---|---|---|
| 3,890,192 | A | * | 6/1975 | Della Vite | 156/571 |
| 4,188,250 | A | * | 2/1980 | Grass | 156/253 |
| 4,188,251 | A | * | 2/1980 | Grass | 156/248 |
| 4,188,427 | A | * | 2/1980 | Grass | 428/42.2 |
| 4,324,058 | A | | 4/1982 | Sherwick et al. | |
| 4,473,429 | A | | 9/1984 | Crankshaw | |
| 4,727,667 | A | | 3/1988 | Ingle | |
| 4,759,454 | A | | 7/1988 | Nowicki et al. | |
| 4,849,043 | A | | 7/1989 | Instance | |
| 4,863,772 | A | * | 9/1989 | Cross | 428/41.8 |
| 5,264,265 | A | | 11/1993 | Kaufmann | |
| 5,342,093 | A | | 8/1994 | Weernink | |
| 5,389,415 | A | * | 2/1995 | Kaufmann | 283/80 |
| 5,443,668 | A | * | 8/1995 | Zaborney et al. | 156/86 |
| 5,568,898 | A | | 10/1996 | Gelardi et al. | |
| 5,672,224 | A | * | 9/1997 | Kaufmann | 156/197 |
| 6,073,377 | A | | 6/2000 | Mehta | |
| 6,155,322 | A | * | 12/2000 | Landan et al. | 156/542 |
| 6,332,631 | B1 | * | 12/2001 | Kirk | 283/81 |

OTHER PUBLICATIONS

Smyth Companies, Inc. Internet information accessed Jul. 23, 2001. http://www.smythco.com/package/wrapandahalf.html.

* cited by examiner

*Primary Examiner*—Monica S. Carter
(74) *Attorney, Agent, or Firm*—Walter K. Roloff; Charles G. Mersereau

(57) ABSTRACT

An extended text wrap label includes a base ply and at least one top ply. The base ply has a first lengthwise dimension, a first widthwise dimension, a top surface that is capable of bearing graphic images, and a bottom surface that is capable of bearing graphic images and capable of being adhesively coupled to an object to be labeled. The at least one top ply has a second lengthwise dimension, a second widthwise dimension, a front surface that is capable of bearing graphic images, and a back surface that is also capable of bearing graphic images. The base ply and the at least one top ply are adhesively coupled, in a first portion of the label, to each other such that the top surface of the base ply and the back surface of the at least one top ply are in contiguous juxtaposition with each other along the first lengthwise dimension and the second lengthwise dimension, respectively, and along the first widthwise dimension and the second widthwise dimension, respectively. Also, the base ply and the at least one top ply are, in a second portion of the label, resealably coupled to each other.

21 Claims, 4 Drawing Sheets

10

EXTENDED TEXT WRAP LABEL AND METHOD OF MANUFACTURE THEREOF

FIELD OF THE INVENTION

The present invention relates generally to labels. The invention relates specifically to an extended text wrap label that may be used with existing roll-fed wrap labeling machines for application to containers and like objects.

BACKGROUND OF THE INVENTION

In the printing arts, and in particular in the commercial printed label art for labeling and decorating consumer products, there exists a continual demand for labels and decorations which not only appeal to consumers, but also bear ever increasing amounts of printed information. For example, labels for identification of consumer health care and pharmaceutical products are often required by governmental regulations to describe in painstaking detail their compositions and ingredients. As new food and drug laws are passed, regulations require the inclusion of increasing amounts of label information.

One label that has gained wide popularity is a so-called "wrap" label. A wrap label commonly utilizes a continuous label substrate or base ply comprising paper, or a clear or opaque film such as polypropylene, or a combination of paper and film. The base ply is usually rectangular, as defined by a desired label width associated with a widthwise dimension and a desired label length associated with a lengthwise dimension (transverse to the widthwise dimension). The base ply also has, of course, opposing first and second ends, along with front and back surfaces. Desired graphics are typically printed on the front surface of the base ply, and may also be printed on the back surface. In application of the wrap label to a commonly cylindrical container, a widthwise portion of the back surface of the base ply at the first end thereof is adhered to the object to be labeled, by means of a permanent adhesive. The base ply, having been adhesively secured to the container at the first end, is then wrapped around the container and is adhesively secured to the container at the second end of the base ply adjacent to the first end. The length of the base ply is usually chosen to nearly match a circumference of the container, to minimize unnecessary overlap of the opposing ends of the label substrate applied to the container. The application of the wrap label to the container may be carried out by any suitable roll-fed label applicator, such as are available, for example, from Krones A. G. of Regensburg, Germany, and from B&H Labeling Systems of Ceres, Calif., U.S.A.

In general in the labeling and packaging arts, various forms of so-called "extended text" labels have been proposed to provide increased printed information on labels. One such extended text label type that has gained wide popularity is the booklet type label, where a base ply is joined to a top ply via an adhesive coupling or "hinge" between the two plies. An example of this type of label is disclosed in U.S. Pat. No. 5,264,265 issued to Kaufmann, entitled "PEELBACK RE-SEALABLE MULTI-PLY LABEL".

Attempts have been made to provide an extended-text wrap label. For example, U.S. Pat. No. 4,727,667 issued to Ingle, entitled "EXTENDED WRAP AROUND LABELS", discloses a pressure sensitive adhesive label that is of a sufficient length (i.e., greater than a circumference of a container to which it is to be applied) so that it may be wrapped around an exterior surface of the container and overlap itself. A portion of the overlapping label is provided with lacquer or ink to facilitate adhesive release therebetween.

In U.S. Pat. No. 5,342,093 issued to Weernink, entitled "WRAP AROUND LABEL", a label includes first, central, and second portions sequentially lengthwise along a single label ply. The first and central portions together have a length that is substantially equal to an outer circumference of a container to be labeled. The second portion has a length that is substantially equal to the first portion. When the label is adhered to the container, the second portion of the single ply overlaps the first portion.

In U.S. Pat. No. 6,073,377 issued to Mehta, entitled "OVER-WRAP LABEL", a label substrate is provided having first and second ends, and first and second major surfaces. A length of the substrate is chosen so that the second end thereof may extend around a container to which the label is being applied, over the first major surface, and overlap the first end. A combination of an adhesive and a release agent is utilized so that the second end is releasably securable to the second major surface.

Also, Smyth Companies, Inc. discloses its WRAP AND A HALF™ product (http://www.smythco.com/package/wrapandahalf.html) as a typical cut label used on cans and bottles that is simply a longer printed label. A length of the Smyth label product may be chosen to extend 10–100% beyond a circumference of a container to be labeled.

Labels such as those disclosed above, however, cannot be used with typical roll-fed wrap labeling machines used by customers buying such labels and applying them to their product containers, packaging, and like objects to be labeled. Specifically, the disclosed labels require, relative to roll-fed label application machines, that extensive and complex tooling changes be made to account for the longer, overlapping label ply lengths resulting in longer "repeats" as known in the art. Additionally, the disclosed labels often require multiple adhesive and release coating depositions, resulting in longer label fabrication and application times. Further, the known labels have been commonly required to be constructed from relatively expensive pressure-sensitive web materials.

Therefore, there exists a need for an extended text wrap label that does not require modification by customers of their existing roll-fed wrap labeling machines, and does not require significant changes to materials and adhesive specifications. There also exists a need for such a wrap label that may be constructed from relatively inexpensive film and paper web materials.

It is generally accepted and well-known in the label making arts that in-line printing and converting processes offer the most cost-effective label production. An exemplary in-line method is disclosed in U.S. Pat. No. 4,849,043 issued to Instance, entitled "METHOD OF PRODUCING LABELS".

Therefore, there also exists a need for an in-line converting and printing process for manufacture of such extended text wrap labels.

SUMMARY OF THE INVENTION

An object of the present invention is to provide an extended text wrap label that is inexpensive and simple to produce.

Another object of the present invention is to provide an extended text wrap label that does not require modification of existing roll-fed wrap labeling machines for application of the label to an object to be labeled.

A further object of the present invention is to provide an in-line converting and printing process for manufacture such labels.

In accordance with the present invention, an extended text wrap label includes a base ply and at least one top ply. The base ply has a first lengthwise dimension, a first widthwise dimension, a top surface that is capable of bearing graphic images, and a bottom surface that is also capable of bearing graphic images and capable of being adhesively coupled to an object to be labeled. The at least one top ply has a second lengthwise dimension, a second widthwise dimension, a front surface that is capable of bearing graphic images, and a back surface that is also capable of bearing graphic images. The base ply and the at least one top ply are adhesively coupled, in a first portion of the label, to each other such that the top surface of the base ply and the back surface of the at least one top ply are in contiguous juxtaposition with each other along the first lengthwise dimension and the second lengthwise dimension, respectively, and along the first widthwise dimension and the second widthwise dimension, respectively. Also, the base ply and the at least one top ply are, in a second portion of the label, resealably coupled to each other.

DETAILED DESCRIPTION OF THE INVENTION

Figure 1:
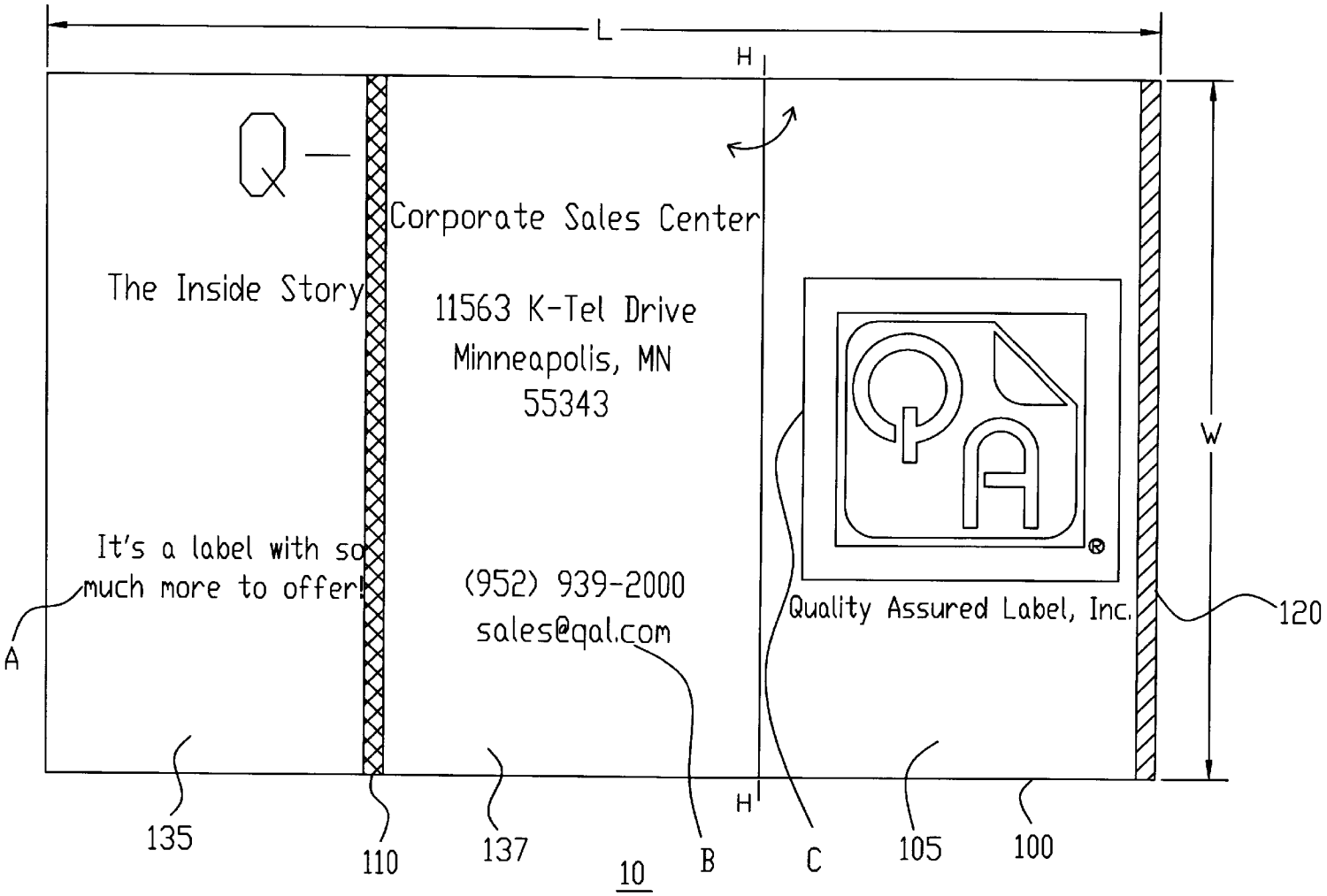
FIG. 1 is an illustration of an extended text wrap label, constructed in accordance with the present invention.
Figure 2:
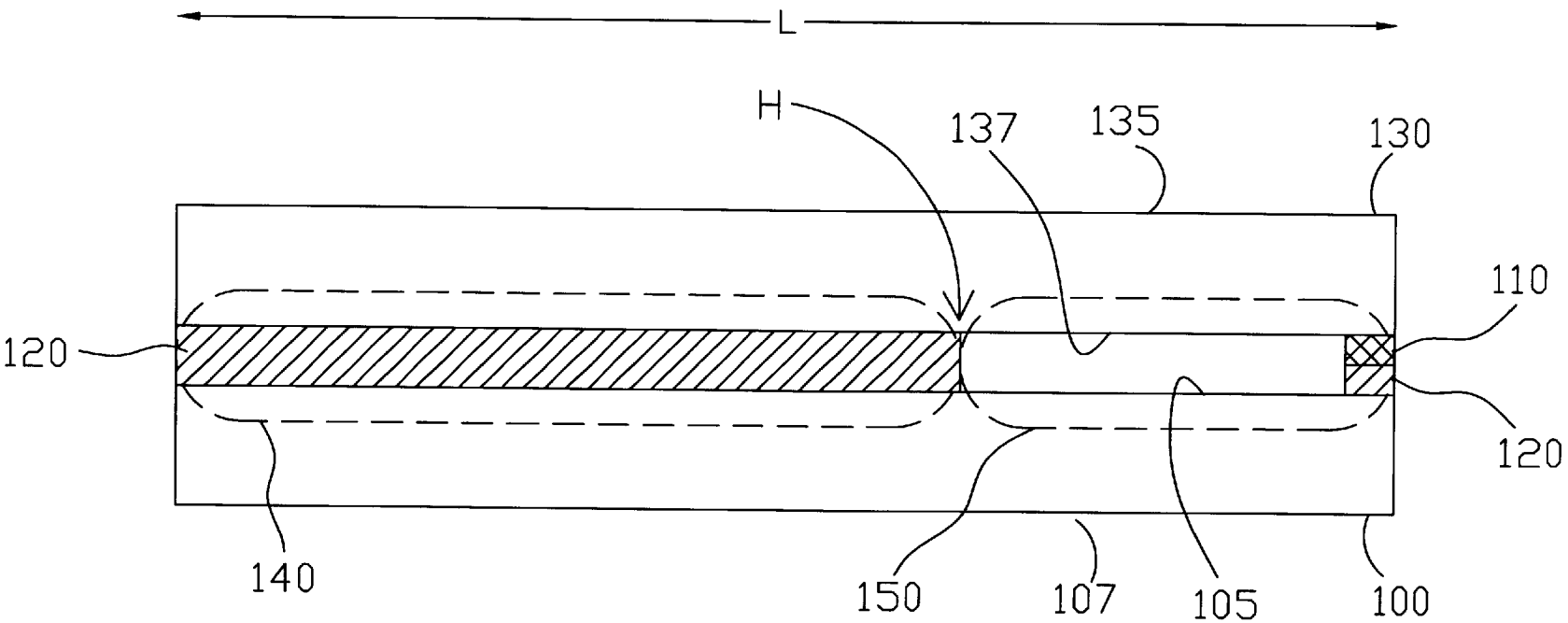
FIG. 2 is a magnified cross-sectional view of the label of FIG. 1.

Referring to FIGS. 1 and 2, there shown are plan and cross-sectional views, respectively, of an extended text wrap label 10. It is to be noted that FIG. 1 depicts label 10 in use, or opened, while FIG. 2 depicts a closed condition.

In the two figures, label 10 includes a base ply 100 having a top surface 105 and a bottom surface 107, a release coating 110, an adhesive coating 120. Label 10 further includes a top ply 130 having a front surface 135 and a back surface 137, a coupled portion 140, and a partially uncoupled portion 150. Label 10 may further include a tab means 160 (as will be described with reference to FIG. 4).

Base ply 100 and top ply 130 are preferably any commercially available web-like film materials that are capable of use in an in-line printing and converting process (as will be further described relative to manufacture of label 10). Such a film material may be, for example, polypropylene (e.g., Part No. 350WHPL from AET Films of Terre Haute, Ind.). As used herein, however, "web-like film materials" denotes any suitable label material, including paper, film, polypropylene, polyethylene, polyester, polyvinylchloride, polystyrene, foil, and ethylene vinyl acetate. Preferably, base ply 100 and top ply 130 each has a thickness in a range of about 0.5 mil. to 6.0 mil.

Top surface 105 of base ply 100 is capable of bearing printed graphics thereon, as indicated in FIG. 2 by reference character C; although not illustrated, bottom surface 107 is also capable of bearing printed graphics thereon. Likewise, both front surface 135 and back surface 137 of top ply 130 are capable of bearing printed graphics as indicated by characters A and B.

In construction of label 10, and with particular reference to FIG. 2, coupled portion 140 and partially uncoupled portion 150 are defined by selected applications of release coating 110 and adhesive coating 120 to top ply 130 and base ply 100, respectively. Specifically, adhesive coating 120 is applied to selected portions of top surface 105 of base ply 100, in coupled portion 140 and partially uncoupled portion 150 as shown in the figure. Release coating 110 is applied, in turn, to a selected portion of back surface 137 in partially uncoupled portion 150, substantially contiguous with adhesive coating 120 therein. It is to be understood that adhesive coating 120 provided in coupled portion 140 acts to permanently bond together, substantially, top ply 130 and base ply 100; conversely, in uncoupled portion 150, release coating 110 in combination with adhesive coating 120 acts to releasably bond ply 130 and ply 100. This releasable bond in uncoupled portion 150 allows label 10 to be opened so that graphics B and C may be viewed (as shown in FIG. 1). It is also to be appreciated that release coating 110, although depicted in FIG. 2 as having been applied to only a relatively small area of top ply 130 in uncoupled portion 150, may be, if desired for ease of application, applied entirely across back surface 137 in uncoupled portion 150.

Coatings 110 and 120 are preferably chosen from water-based, solvent-based, ultraviolet light activated, and hot melt coatings as are commercially available Craig Adhesives & Coatings Co. of Newark, N.J., and Northwest Coatings Corp. of Oak Creek, Wis. Adhesive coating 120 is chosen to provide secure bonding between base ply 100 and top ply 130 in coupled region 140. Release coating 110 is chosen with respect to and in combination with adhesive coating 120, to provide ease of opening and resealability of label 10 in uncoupled portion 150.

Referring again to both FIGS. 1 and 2, it is to be particularly understood that coupled portion 140 adjacent to uncoupled portion 150 in label 10, forms a so-called "hinge" (about axis H—H in FIG. 1). The hinge about axis H—H facilitates opening and closing of label 10 in use, in booklet fashion.

It is also to be understood that the extended text wrap label 10 of the present invention provides extended text in booklet fashion without employing an "overwrap" ply (as disclosed in the aforementioned patents). That is, label 10 utilizes a multi-ply format (base ply 100 and top ply 130) in contiguous juxtaposition with each other, as shown in the figures. Thus, it is to be particularly appreciated and understood that label 10 does not increase an overall end-to-end label length, so that customers' existing roll-fed wrap labeling machines for applying the wrap label to the container may be used without time-consuming and costly modifications. Further, as will be described below, fabrication of label 10 in an in-line process will be relatively faster than fabrication of existing overwrap ply labels because such overwrap labels inherently use relatively longer material lengths which results in smaller finished label yields.

Figure 3:
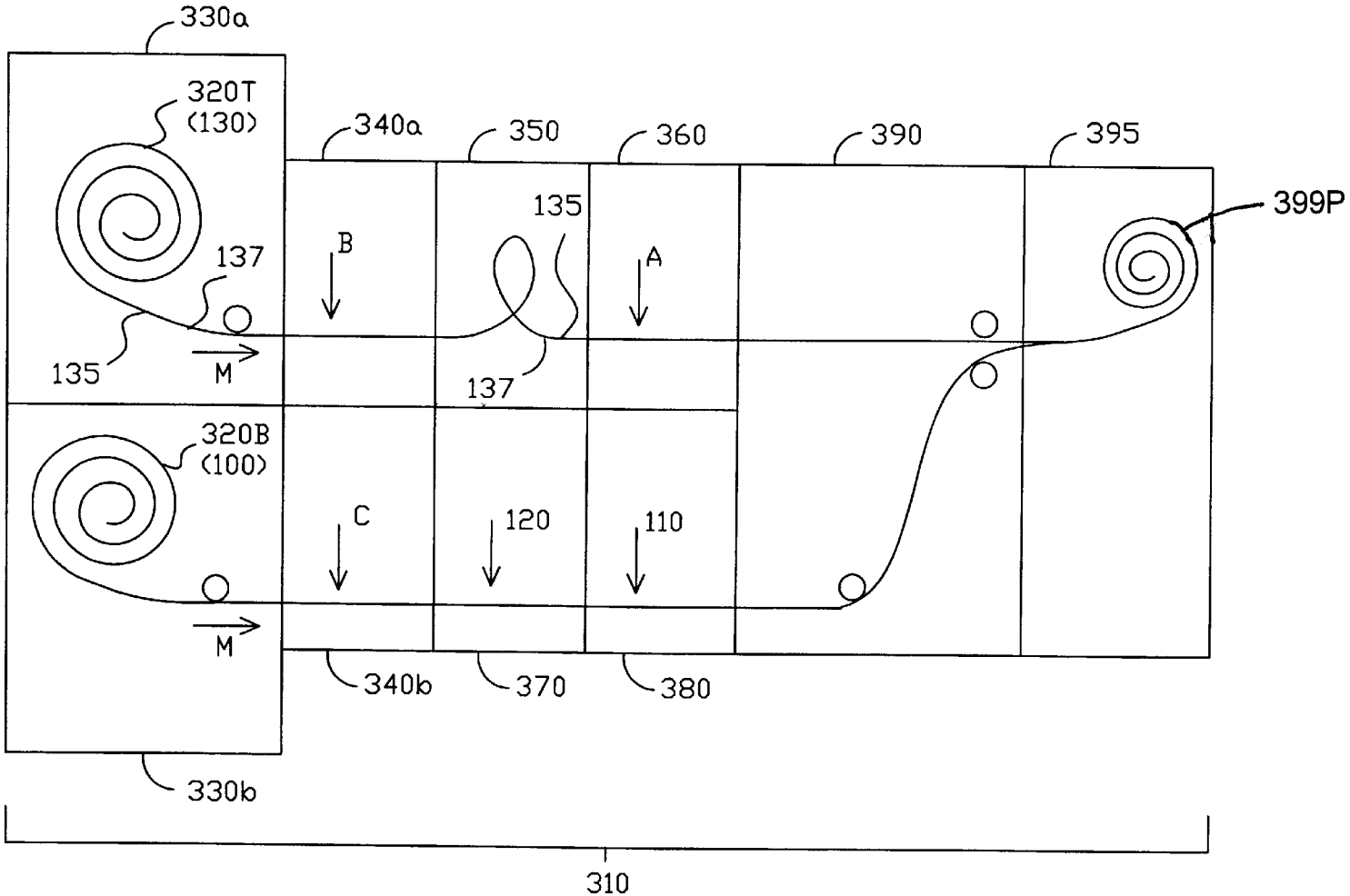
FIG. 3 is a schematic diagram of a manufacturing method for production of a label of the present invention.

With attention, now, to FIG. 3, there depicted in schematic fashion is an exemplary in-line web press manufacturing installation 300 including multi-unit in-line printing and converting press 310, for mass production of label 10.

Multi-unit press 310 of installation 300 includes unwind units 330*a* and 330*b*, first and second printing units 340*a* and 340*b*, a web turning unit 350, a third printing unit 360, a first coating unit 370, a second coating unit 380, a nip roller web joining unit 390, and a final re-wind unit 395, as will now each be further described in construction of a web of labels 10.

It is to be understood that press 310 is selectively capable of providing a variable number of print stations for application and drying of pigmented inks, coatings, and adhesives. As understood by those of ordinary skill in the printing arts, the exemplary multi-unit press 310 may be any suitable narrow- or wide-web press such as a flexographic, letterpress, gravure, screen, or offset press. Such presses are commercially available from, for example, Comco International of Milford, Ohio, or Mark Andy Inc. of St. Louis, Mo.

To begin the construction of labels 10, an unsupported film web 320T (top ply 130 in FIG. 2) is supplied in a conventional roll form to press 310 at unwind unit 330*a*, and in a lengthwise machine direction M thereto. Simultaneously, an unsupported film web 420B (base ply 100 in FIG. 2) is also preferably supplied in a conventional roll form to press 310 at unwind unit 330*b* in lengthwise machine direction M. Film webs 320T and 320B are any suitable in-line web material (e.g., the aforementioned AET Films material).

Unwind units 330*a–b* pass webs 320T-B, respectively, to first printing units 340*a* and 340*b*, respectively, where printed graphics B and C (as depicted in FIG. 1) are, respectively, printed on back surface 137 of top ply 130 and on top surface 105 of base ply 100.

Web 320B bearing graphics C is then passed to first coating unit 370, where adhesive coating 120 is selectively applied thereto (as depicted in FIG. 2). Web 320B then passes to second coating unit 380, where release coating 110 is applied thereto (also as depicted in FIG. 2).

While web 320B is being processed as aforedescribed, web 320T is simultaneously passed to web turning unit 350, where web 320T is turned over. The turning of web 320T may be provided by, for example, a turn-bar technique as is known in the art. Additionally, web 320T is then passed to third printing unit 360, where printed graphics A (as depicted in FIG. 1) are printed on front surface 135 of top ply 130.

Webs 320T and 320B then pass from units 360 and 380, respectively, to nip roller web joining unit 390. At unit 390, webs 320T-B are adhesively joined by way of adhesive coating 120. Referring also to FIG. 2, this adhesive joining of webs 320T-B forms the aforementioned coupled portion 140 which acts to permanently bond together, substantially, top ply 130 and base ply 100. Adhesive coating 120 also provides, in combination with release coating 110, the aforementioned releasable bond between ply 130 and ply 100 in uncoupled portion 150 of label 10.

Figure 4:
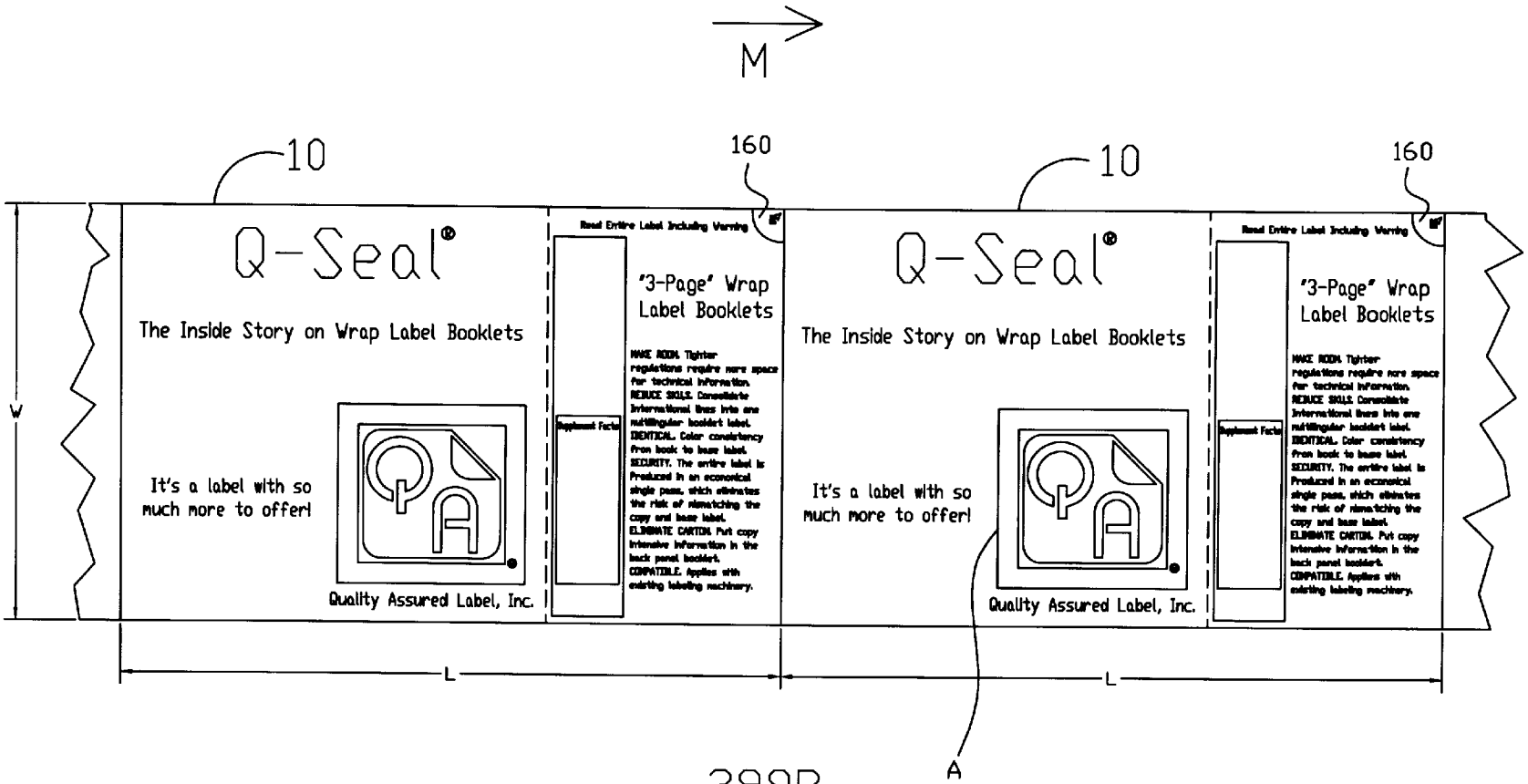
FIG. 4 is a plan view of a web of labels as shown individually in FIG. 1, produced in the method of FIG. 3.

Adhesively joined webs 320T-B then pass to final re-wind unit 395 where the combined webs are re-wound into a supply roll of a finished product 399P carrying individual labels 10 (as additionally shown in FIG. 4). Finished product 399P is then made available to a customer for use in the customer's roll-fed wrap labeling machines.

While the present invention has been particularly shown and described with reference to the accompanying figures, it will be understood, however, that other modifications thereto are of course possible, all of which are intended to be within the true spirit and scope of the present invention. It should be appreciated that components of the invention aforedescribed may be substituted for other suitable components for achieving desired similar results, or that various accessories may be added thereto.

For example, top ply 130 could comprise multiple plies, to form a multi-page booklet-type extended text wrap label.

It is to be appreciated that any of the aforedescribed coatings and graphics may be selectively provided in any suitable combination on label 10, for a particular use thereof. For example, back surface 137 of top ply 130 could receive coatings 110 and 120 thereon (as described relative to top surface 105 of base ply 100).

It is to be understood that any suitable alternatives may be employed to provide the extended text wrap label of the present invention, along with its manufacturing scheme.

Lastly, the choice, of course, of compositions, sizes, and strengths of various aforementioned components of extended text wrap label 10 are all a matter of design choice depending upon intended uses of the present invention.

Accordingly, these and other various changes or modifications in form and detail of the present invention may also be made therein, again without departing from the true spirit and scope of the invention as defined by the appended claims.

What is claimed is:

1. An extended text roll-fed label for application with separately supplied adhesive to an object to be labeled using a roll-fed wrap labeling machine, said label comprising:

(a) a base ply having a top surface and a bottom surface, said bottom surface of said base ply being adhesive-free;

(b) at least one top ply having a front surface and a back surface overlaying said base ply and having a fixed end and a free end;

(c) a first adhered portion including an amount of adhesive joining a portion of said base ply and the fixed end of said at least one top ply and thereby forming a hinge therebetween;

(d) a second adhered portion including an amount of adhesive spaced from said hinge for releasably, resealably coupling said free end of said at least one top ply and said base ply; and (e) an adhesive-free portion between said first and said second adhered portions.

2. A label as in claim 1 wherein said second adhered portion includes a release coating.

3. A label as in claim 1 wherein said second adhered portion comprises a narrow strip at the free end of said top ply.

4. A label as in claim 3 wherein said second adhered portion includes a release coating.

5. A label as in claim 1 wherein said top surface of said base ply and all surfaces of said at least one top ply carry graphic images thereon.

6. A label as in claim 1 wherein all surfaces of all plies carry graphic images thereon.

7. A label as in claim 1 wherein said base ply and said at least one top ply are congruent.

8. A label as in claim 4 wherein said top surface of said base ply and all surfaces of said at least one top ply carry graphic images thereon.

9. A label as in claim 4 wherein all surfaces of all plies carry graphic images thereon.

10. A label as in claim 4 wherein said base ply and said at least one top ply are congruent.

11. A label as in claim 10 wherein said top surface of said base ply and all surfaces of said at least one top ply carry graphic images thereon.

12. A label as in claim 10 wherein all surfaces of all plies carry graphic images thereon.

13. A label as in claim 1 further comprising lamination means provided on said front surface of said at least one top ply for protection thereof.

14. A label as in claim 1 wherein said base ply and said at least one top ply are selected from the group consisting of paper, film, polypropylene, polyethylene, polyester, polyvinylchloride, polystyrene, foil and ethylene vinyl acetate.

15. A label as in claim 1 wherein said base ply and said at least one top ply are adhesively bonded to each other in said first adhered portion by means of an adhesive coating selected from the group consisting of a water-based coating, a solvent-based coating, an ultraviolet light activated coating and a hot melt coating.

16. A label as in claim 1 wherein said base ply and said at least one top ply are releasably, resealably coupled to each other in said second adhered portion by means of a release coating selected from the group consisting of a water-based coating, a solvent-based coating, an ultraviolet light activated coating and a hot melt coating.

17. A label as in claim 1 further comprising at least one tab means provided on said front surface of said at least one top ply for promoting uncoupling of said at least one top ply from said base ply at said free end.

18. A method of manufacture of extended text roll-fed labels for application with separately supplied adhesive to objects to be labeled using a roll-fed wrap labeling machine, comprising steps of:

(a) providing a first web material including a top ply having a front surface and a back surface;

(b) providing a second web material including a base ply having a top surface and a bottom surface;

(c) selectively providing (i) graphic images on said back surface of said top ply, and (ii) graphic images on said top surface of said base ply;

(d) selectively applying an adhesive coating to a first portion selected from the group consisting of a first area of said back surface of said top ply and a first area of said top surface of said base ply;

(e) selectively applying in combination an adhesive coating and a release coating between a second portion of said base ply and said top ply;

(f) selectively providing graphic images on said front surface of said top ply; and (g) adhesively joining said first web and said second web in base ply and top ply matching arrangement in said first portion thereby forming a hinge therebetween and releasably, resealably joining said first and said second webs in base ply and top ply matching arrangement in said second portion.

19. A method as in claim 18 further comprising the step of selectively providing graphic images on said bottom surface of said base ply.

20. A method as in claim 18 further comprising the step of re-winding said adhesively joined first and second webs into a finished product supply roll.

21. A method as in claim 18 further comprising the steps of joining at least one additional ply in the manner of said top ply and said base ply.

* * * * *

UNITED STATES PATENT AND TRADEMARK OFFICE

CERTIFICATE OF CORRECTION

PATENT NO. : 6,755,442 B2
DATED : June 29, 2004
INVENTOR(S) : Joseph D. Franko, Sr. and Todd C. Wentz It is certified that error appears in the above-identified patent and that said Letters Patent is hereby corrected as shown below:

Column 3,
Line 2, “manufacture” should read -- manufacturing --;
Line 45, “110, an adhesive” should read -- 110, and an adhesive --;
Line 63, “Fig. 2” should read -- Fig. 1 --; and Column 5,
Line 14, “420B” should read -- 320B --.

Signed and Sealed this

Tenth Day of August, 2004

JON W. DUDAS
*Acting Director of the United States Patent and Trademark Office*